US009318836B2

(12) United States Patent
Yagi et al.

(10) Patent No.: US 9,318,836 B2
(45) Date of Patent: Apr. 19, 2016

(54) ELECTRIC CONNECTOR

(71) Applicant: DAI-ICHI SEIKO CO., LTD., Kyoto (JP)

(72) Inventors: Sakai Yagi, Shizuoka (JP); Takuya Takeda, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/606,760

(22) Filed: Jan. 27, 2015

(65) Prior Publication Data

US 2015/0222043 A1 Aug. 6, 2015

(30) Foreign Application Priority Data

Feb. 6, 2014 (JP) ..... 2014-021522
Mar. 7, 2014 (JP) ..... 2014-045428

(51) Int. Cl.
*H01R 13/502* (2006.01)

(52) U.S. Cl.
CPC ..... *H01R 13/502* (2013.01)

(58) Field of Classification Search
CPC ..... H01R 13/6456; H01R 13/64
USPC ..... 439/680, 489, 350–358
See application file for complete search history.

(56) References Cited

U.S. PATENT DOCUMENTS 5,338,219 A * 8/1994 Hiramoto ..... H01R 13/6272 439/350
5,425,650 A * 6/1995 Maeda ..... H01R 13/631 439/374
5,643,003 A * 7/1997 Myer ..... H01R 13/641 439/352
5,672,073 A * 9/1997 Matsumura ..... H01R 13/641 439/188
5,807,130 A * 9/1998 Miller ..... H01R 13/641 439/352
5,910,027 A * 6/1999 Wayt ..... H01R 13/641 439/352
5,928,038 A * 7/1999 Berg ..... H01R 13/6272 439/489
5,947,763 A * 9/1999 Alaksin ..... H01R 13/4362 439/352
6,068,507 A * 5/2000 Popa ..... H01R 13/641 439/352
6,171,130 B1 * 1/2001 Yoshida ..... H01R 13/641 439/350
6,354,860 B1 * 3/2002 Miller ..... H01R 13/641 439/352
6,364,718 B1 * 4/2002 Polgar ..... H01R 13/64 439/488
6,419,515 B1 * 7/2002 Okayasu ..... H01R 13/627 439/352
6,439,915 B2 * 8/2002 Kurimoto ..... H01R 13/6272 439/352

(Continued)

FOREIGN PATENT DOCUMENTS

JP S58-51586 7/1983 ..... H01R 13/639
JP 2004103449 4/2004 ..... H01R 13/639
JP 2012142089 7/2012 ..... H01R 13/42

*Primary Examiner* — Ross Gushi
(74) *Attorney, Agent, or Firm* — Hayes Soloway P.C.

(57) ABSTRACT

An electric connector includes a first housing including a first wall, second and third walls both extending in parallel from the first wall, and a fourth wall connecting the second and third walls to each other, the first to fourth walls defining an inner space in the first housing, and a second housing to be fit into the inner space, the first housing including a first projection protruding into the inner space from an inner surface of the first wall, and a first recess formed at the second and third walls, the second housing including a second recess through which the first projection is guided, a wall to make abutment with the first projection when the second housing is inserted in an upside-down posture into the inner space, and a second projection to be fit into the first recess.

9 Claims, 16 Drawing Sheets

(56) References Cited

U.S. PATENT DOCUMENTS 6,579,118 B2 * 6/2003 Endo ..... H01R 13/641 439/352
6,676,433 B1 * 1/2004 Ozaki ..... H01R 13/5025 439/350
6,679,719 B2 * 1/2004 Endo ..... H01R 13/641 439/352
6,685,500 B2 * 2/2004 Nakamura ..... H01R 13/6271 439/352
7,736,197 B2 * 6/2010 Takeda ..... H01R 13/6456 439/680
7,753,613 B2 * 7/2010 Tsuji ..... H01R 13/6272 403/326
8,113,881 B2 * 2/2012 Sakamoto ..... H01R 13/4223 439/595
8,152,556 B2 * 4/2012 Wu ..... H01R 13/635 439/357
8,182,296 B2 * 5/2012 De Blieck ..... H01R 43/16 439/378
8,197,265 B1 * 6/2012 Lee ..... H01R 31/06 439/105
8,202,112 B2 * 6/2012 Gabrielson ..... H01R 13/7032 439/507
8,231,401 B2 * 7/2012 Amano ..... H01R 13/6272 439/357
8,337,235 B2 * 12/2012 Mizutani ..... H01R 13/6272 439/352
8,337,255 B2 * 12/2012 Shamoto ..... H01R 13/6456 439/680
8,348,703 B2 * 1/2013 De Blieck ..... H01R 43/16 439/378
8,366,473 B2 * 2/2013 Kataoka ..... H01R 13/506 439/350
8,517,756 B2 * 8/2013 Song ..... H01R 13/6271 439/357
8,523,594 B2 * 9/2013 Takeda ..... H01R 13/4223 439/352
8,556,651 B1 * 10/2013 Heitmann ..... H01R 13/641 439/489
8,628,344 B2 * 1/2014 Cole ..... H01R 13/6272 439/352
8,758,037 B2 * 6/2014 Chang ..... H01R 13/62 439/354
8,784,132 B2 * 7/2014 Cossette ..... H01R 13/64 439/567
8,858,259 B2 * 10/2014 Chikusa ..... H01R 13/4223 439/595
8,870,586 B2 * 10/2014 Wang ..... H01R 13/6275 439/358
8,876,543 B2 * 11/2014 Oka ..... H01R 13/6272 439/353
8,920,186 B2 * 12/2014 Shishikura ..... H01R 13/506 439/352
8,944,844 B2 * 2/2015 Myer ..... H01R 13/641 439/489
2002/0123260 A1 * 9/2002 Ichio ..... H01R 13/4361 439/352
2008/0064250 A1 * 3/2008 Lee ..... H01R 13/6277 439/352
2008/0233789 A1 * 9/2008 Sakamoto ..... H01R 13/6275 439/357
2008/0293286 A1 * 11/2008 Denpouya ..... H01R 13/4367 439/358
2012/0164866 A1 6/2012 Suemitsu et al. ..... 439/345
2013/0095703 A1 * 4/2013 Liang ..... H01R 13/6456 439/680
2013/0252452 A1 * 9/2013 Bieletzki-Welz ..... H01R 12/58 439/350
2014/0011388 A1 * 1/2014 Muro ..... H01R 13/627 439/352
2014/0017929 A1 * 1/2014 Nagasaka ..... H01R 13/4223 439/350
2014/0024242 A1 * 1/2014 Nagasaka ..... H01R 13/434 439/350
2014/0106598 A1 * 4/2014 Hiramatsu ..... H01R 13/64 439/350
2014/0106602 A1 * 4/2014 Hiramatsu ..... H01R 13/6272 439/357
2014/0106603 A1 * 4/2014 Hiramatsu ..... H01R 13/6272 439/374
2014/0127931 A1 * 5/2014 Urashima ..... H01R 13/506 439/352
2014/0335739 A1 * 11/2014 Sato ..... H01R 13/6456 439/680
2014/0342606 A1 * 11/2014 Endo ..... H01R 13/4223 439/595
2014/0370757 A1 * 12/2014 Endo ..... H01R 13/4223 439/626
2015/0056872 A1 * 2/2015 Endo ..... H01R 13/213 439/733.1
2015/0140853 A1 * 5/2015 Hashimoto ..... H01R 13/7032 439/354
2015/0200486 A1 * 7/2015 Yagi ..... H01R 13/6272 439/354
2015/0200492 A1 * 7/2015 Endo ..... H01R 13/639 439/345
2015/0222040 A1 * 8/2015 Endo ..... H01R 13/424 439/595
2015/0222043 A1 * 8/2015 Yagi ..... H01R 13/502 439/625
2015/0270643 A1 * 9/2015 Myer ..... H01R 13/6273 439/357
2015/0311629 A1 * 10/2015 Yagi ..... H01R 13/6272 439/345

* cited by examiner

ELECTRIC CONNECTOR

BACKGROUND OF THE INVENTION

1. Field of the Invention

The invention relates to an electric connector including a first housing defining an inner space therein, and a second housing to be fit into the inner space.

2. Description of the Related Art

There is known an electric connection including a pair of a first housing defining an inner space therein, and a second housing to be fit into the inner space of the first housing, in which case, the first housing is formed with a projection protruding into the inner space, and the second housing is formed with a recess into which the projection is fit, in order to prevent the second housing from being fit into the inner space in a twisted or upside down posture.

An example of the above-mentioned electric connector is suggested in Japanese Utility Model Application Publication No. S58 (1983)-51586.

FIG. 14 is a perspective view of a female connector 1001 as a part of the suggested electric connector, and FIG. 15 is a perspective view of a male connector 1101 as a part of the suggested electric connector.

As illustrated in FIG. 14, the female connector 1001 is formed with a pair of grooves 1002 at inner surfaces of sidewalls of an opening. As illustrated in FIG. 15, the male connector 1101 is formed with a pair of projections 1102 outwardly protruding from outer surfaces of sidewalls. The projections 1102 are fit into the grooves 1002 when the male connector 1101 is fit into the female connector 1001.

Another example of the above-mentioned electric connector is suggested in Japanese Patent Application Publication No. 2004-103449.

FIG. 16 is a front view of a male housing 1100 of the suggested electric connector, and FIG. 17 is a front view of a female housing 1110 of the suggested electric connector.

The male housing 1100 includes a hood 1101 into which the female housing 1110 is fit. The hood 1101 is formed at an inner surface thereof with first projections 1102 protruding into the hood 1101, and second projections 1103 extending from the first projections 1102. The first and second projections 1102 and 1103 are of L-shaped. The female housing 1110 is formed with first portions 1111 and second portions 1112 extending from the first portions 1111. The first and second portions 1111 and 1112 define L-shaped grooves 1113 into which the first and second projections 1102 and 1103 are fit to thereby prevent the hood 1101 from being outwardly deformed.

FIG. 18 is a perspective view of a conventional male electric connector 2100 having an outer housing 2101 defining an inner space 2102 therein, and FIG. 19 is a perspective view of a conventional female electric connector 2200 having an inner housing 2201 to be fit into the inner space 2102 of the outer housing 2101.

It is supposed that the inner housing 2201 is inserted in a wrong position, specifically, upside down into the inner space 2102 of the outer housing 2101.

The outer housing 2101 is formed with a pair of projections 2103 protruding into the inner space 2102 from an inner surface of the inner space 2102. The inner housing 2201 is formed with a pair of grooves 2202 into which the projections 2103 can be fit only when the inner housing 2201 is fit in a correct position into the inner space 2102 of the outer housing 2101. Accordingly, if the inner housing 2201 is inserted upside down into the inner space 2102 of the outer housing 2101, the projections 2103 make abutment with a thin-wall bottom 2203 of the inner housing 2201.

If the projections 2103 of the outer housing 2101 make intensive abutment with the thin-wall bottom 2203 of the inner housing 2201, the thin-wall bottom 2203 may be damaged.

SUMMARY OF THE INVENTION

In view of the above-mentioned problem in the conventional electric connector, it is an object of the present invention to provide an electric connector capable of preventing a thin-wall portion of an inner housing from being damaged, even if the inner housing is inserted upside down into an inner space of an outer housing, to thereby provide high reliability to the connection of inner and outer housings to each other.

In one aspect of the present invention, there is provided an electric connector including a first housing including a first wall, second and third walls both extending in parallel from the first wall, and a fourth wall connecting the second and third walls to each other, the first to fourth walls defining an inner space in the first housing, and a second housing to be fit into the inner space, the first housing including a first projection protruding into the inner space from an inner surface of the first wall, and a first recess formed at the second and third walls, the second housing including second recess through which the first projection is guided, a wall to make abutment with the first projection when the second housing is inserted in an upside-down posture into the inner space, and a second projection to be fit into the first recess.

Even if the first projection of the first housing makes abutment with the wall of the second housing when the second housing is inserted upside down into the inner space of the first housing, the second projection of the second housing makes abutment with the first housing to thereby reduce a compressive force exerted by the first projection onto the wall.

For instance, the wall is defined as an outer wall thinned by an inner space having a first opening through which a jig is inserted into the space.

Even if the wall is comprised of a wall thinned by a structure of the electric connector, the wall can be prevented from being damaged.

As an alternative, the wall may be defined as a wall formed between a first opening formed at a front of the second housing and a second opening formed at the front of the second housing above the first opening.

It is preferable that the first recess be formed at each of the second and third walls in facing relation.

By forming the first recess at each of the second and third walls, even if the second projection to be fit into the first recess is short in length, a total length of the second projections contributes to enhancement in a strength of the second projections.

It is preferable that the first recess be formed at a location other than a center of the second and third walls in a height-wise direction of the second and third walls.

For instance, the first recess may be formed at an end of the second and third walls in the height-wise direction.

If the second housing is forced to be inserted into the first housing in an upside-down posture, the second projection to be fit into the first recess attempts to outwardly expand a sidewall of the first housing to enter the inner space of the first housing. However, since the first recess is formed at the end of the second and third walls in the direction, the second projection makes abutment with the sidewall of the first housing, and accordingly, the sidewall is difficult to outwardly expand.

It is preferable that the first recess be formed at an end opposite to an end of the second and third walls located closer to the first projection.

If the second housing is forced to be inserted into the first housing in an upside-down posture, the second projection to be fit into the first recess makes abutment with the first housing in the vicinity of the first projection. Thus, the second projection reduces a compressive force exerted by the first projection onto the wall, by making abutment with the sidewall of the first housing in the vicinity of the first projection.

It is preferable that the first recess be formed at inner surfaces of the second and third walls each having a flat outer surface.

The second and third walls do not have a raised portion on an outer surface thereof. Consequently, the first housing can be designed to have a reduced width in comparison with a housing including sidewalls having raised portions on an outer surface thereof in accordance with the first recess.

It is preferable that the second projection be formed on the level with the wall relative to the fourth wall.

If the second housing is forced to be inserted into the first housing in an upside-down posture, the second projection makes abutment with the sidewall of the first housing. Thus, the second projection reduces a compressive force exerted by the first projection onto the wall, by making abutment with a sidewall of the first housing.

The advantages obtained by the aforementioned present invention will be described hereinbelow.

In the electric connector in accordance with the present invention, the second projection of the second housing makes abutment with the first housing to thereby reduce a compressive force exerted by the first projection onto the wall. Accordingly, even if the second housing is forced to be inserted into the first housing in an upside-down posture, it is possible to prevent the wall of the second housing from being damaged, ensuring high reliability in the connection of the first and second housings with each other.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

The electric connector in accordance with a preferred embodiment of the present invention is explained hereinbelow with reference to the drawings. In the specification, a wording "front" refers to a side on which electric connectors are coupled to each other, and a wording "rear" refers to its opposite side. A wording "down" or "below" refers to a side on which the electric connector is mounted on a printed circuit board, and a wording "up" or "above" refers to its opposite side.

Figure 1:
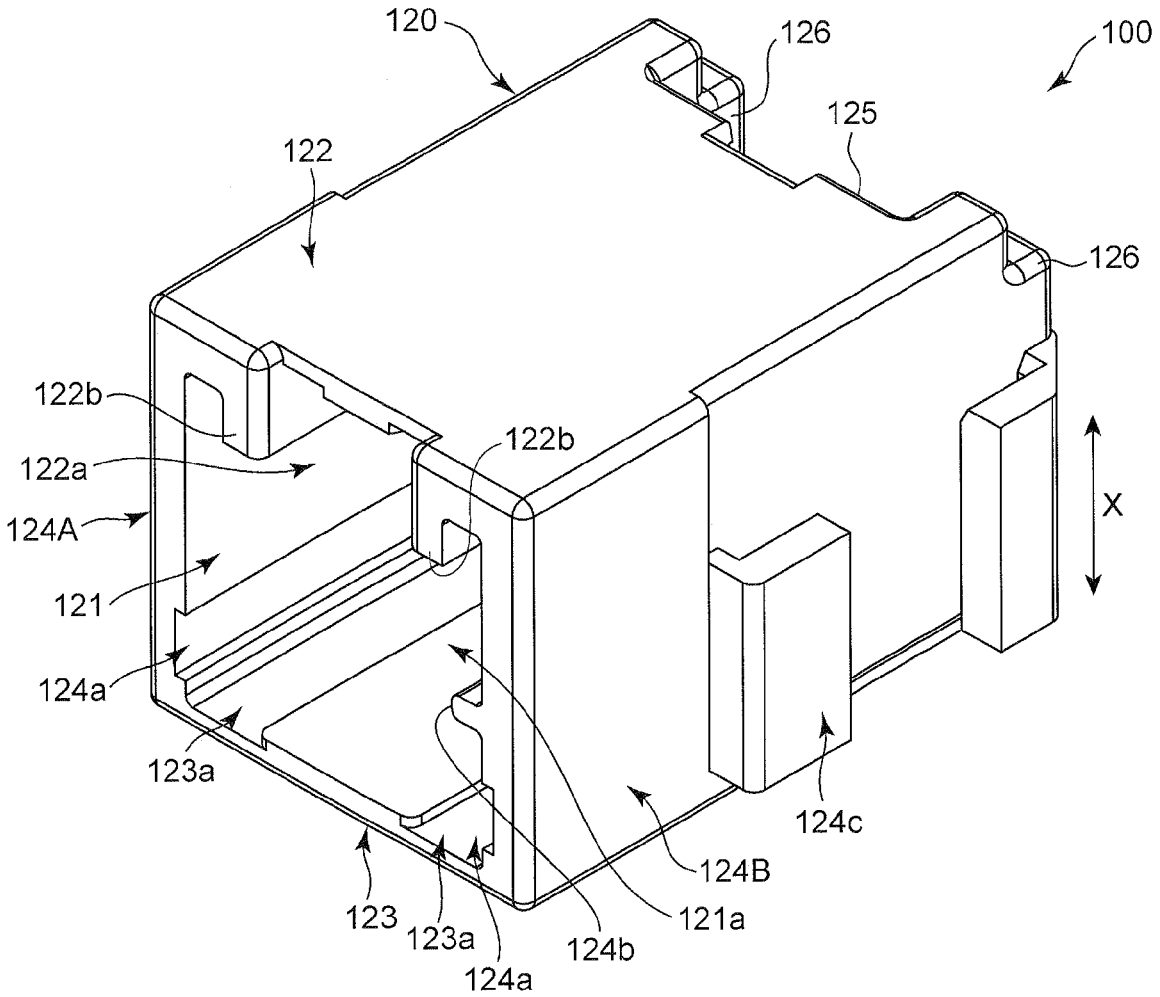
FIG. 1 is a front-upward perspective view of a male electric connector comprising a part of the electric connector in accordance with a preferred embodiment of the present invention.
Figure 2:
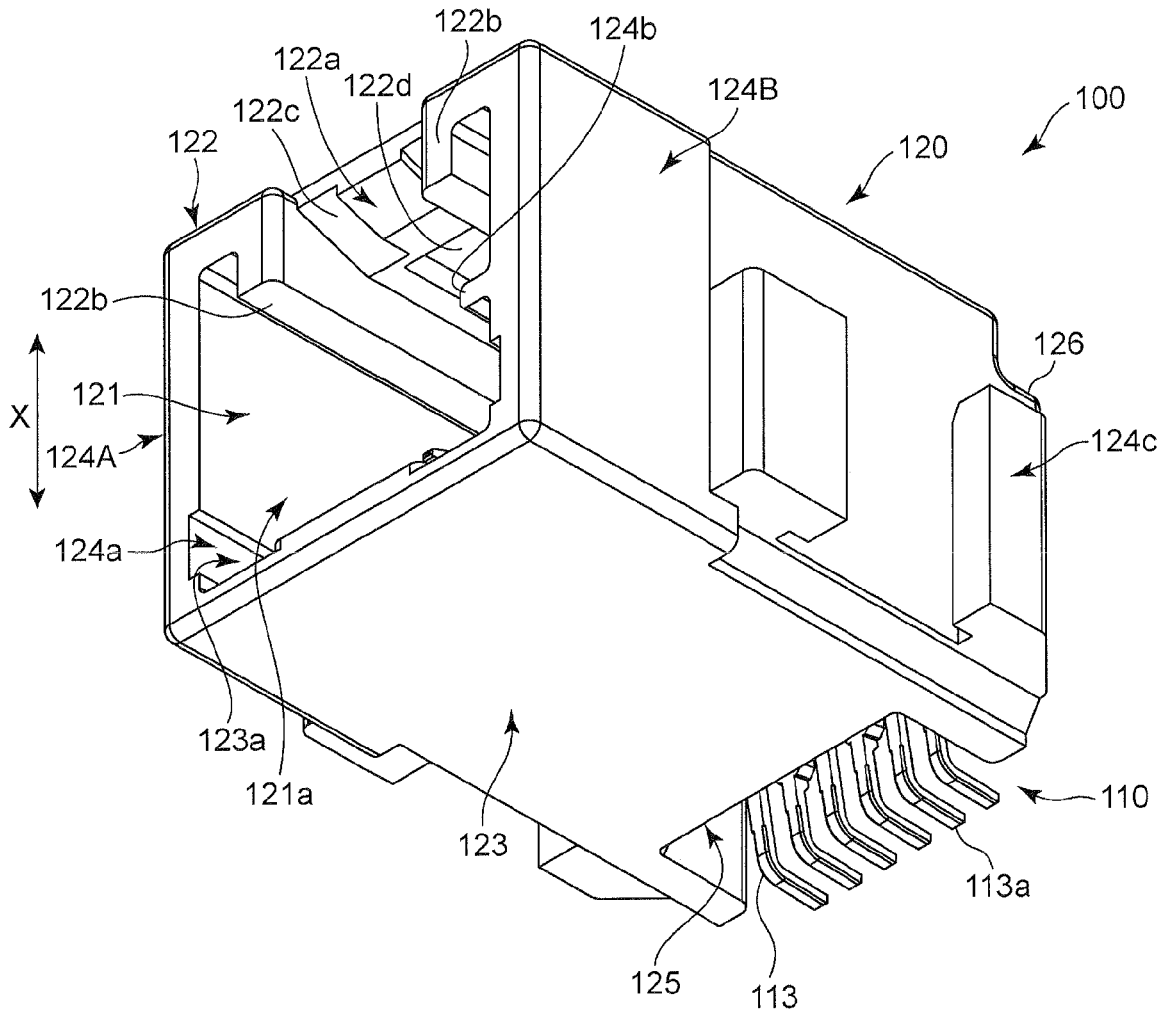
FIG. 2 is a front-downward perspective view of the male electric connector illustrated in FIG. 1.
Figure 3:
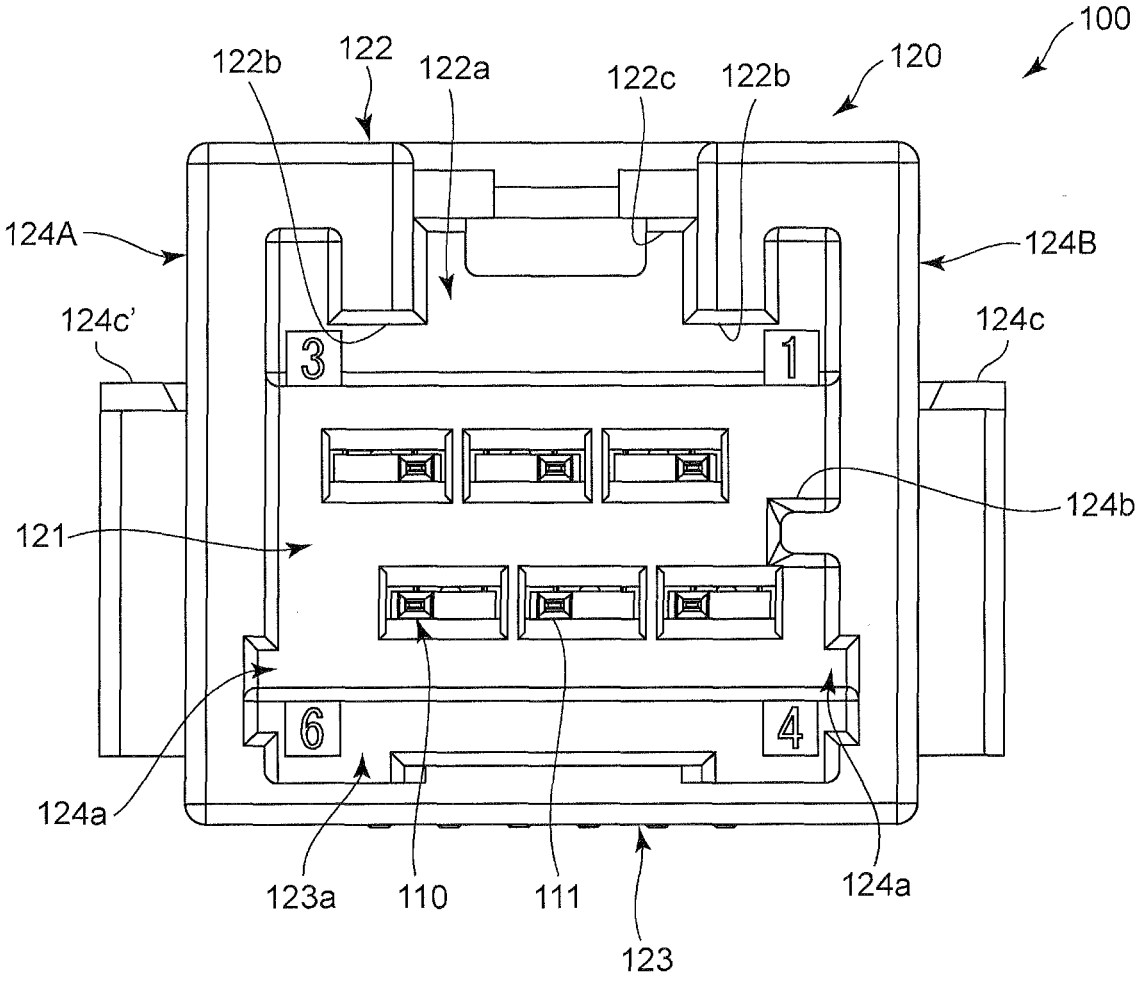
FIG. 3 is a front view of the male electric connector illustrated in FIG. 1.
Figure 4:
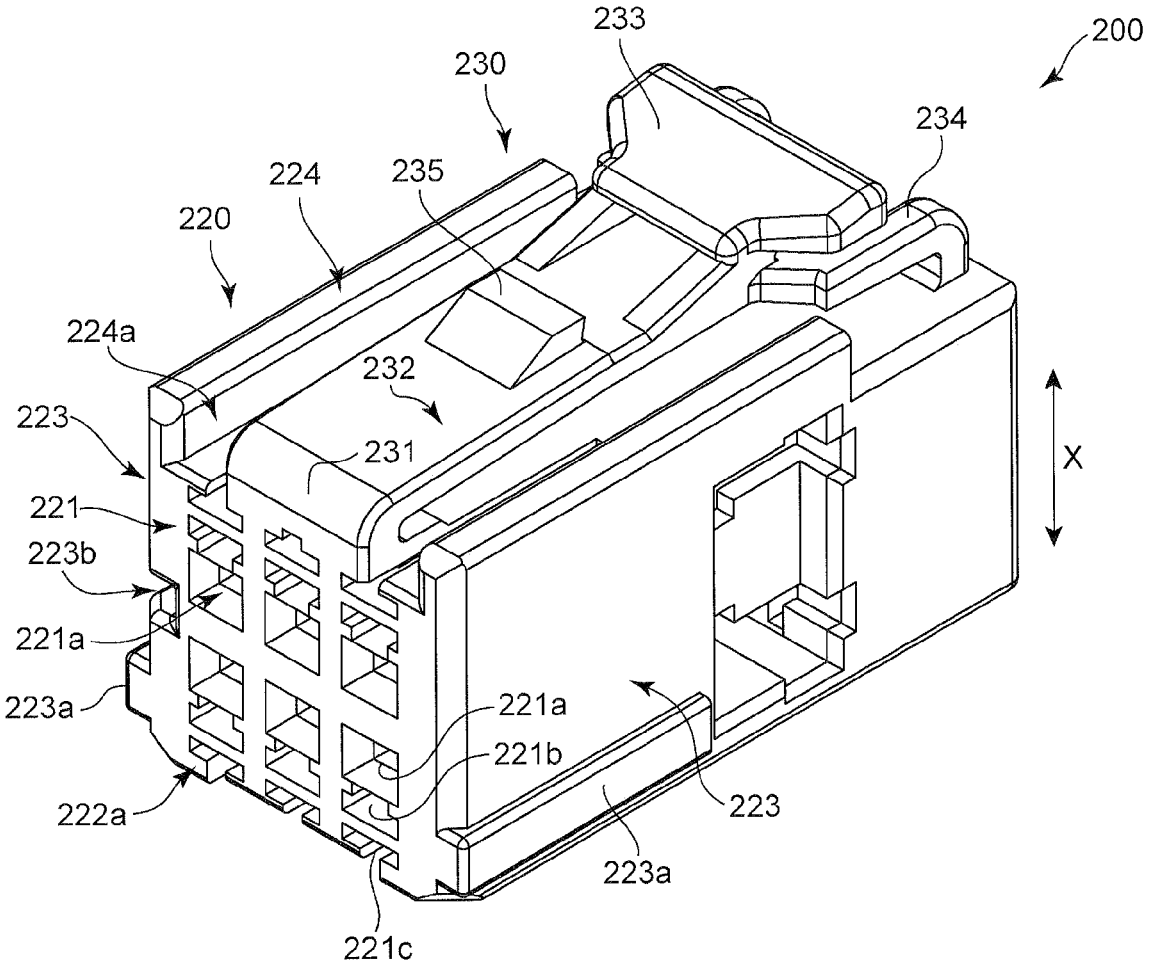
FIG. 4 is a front-upward perspective view of a female electric connector comprising a part of the electric connector in accordance with a preferred embodiment of the present invention.
Figure 5:
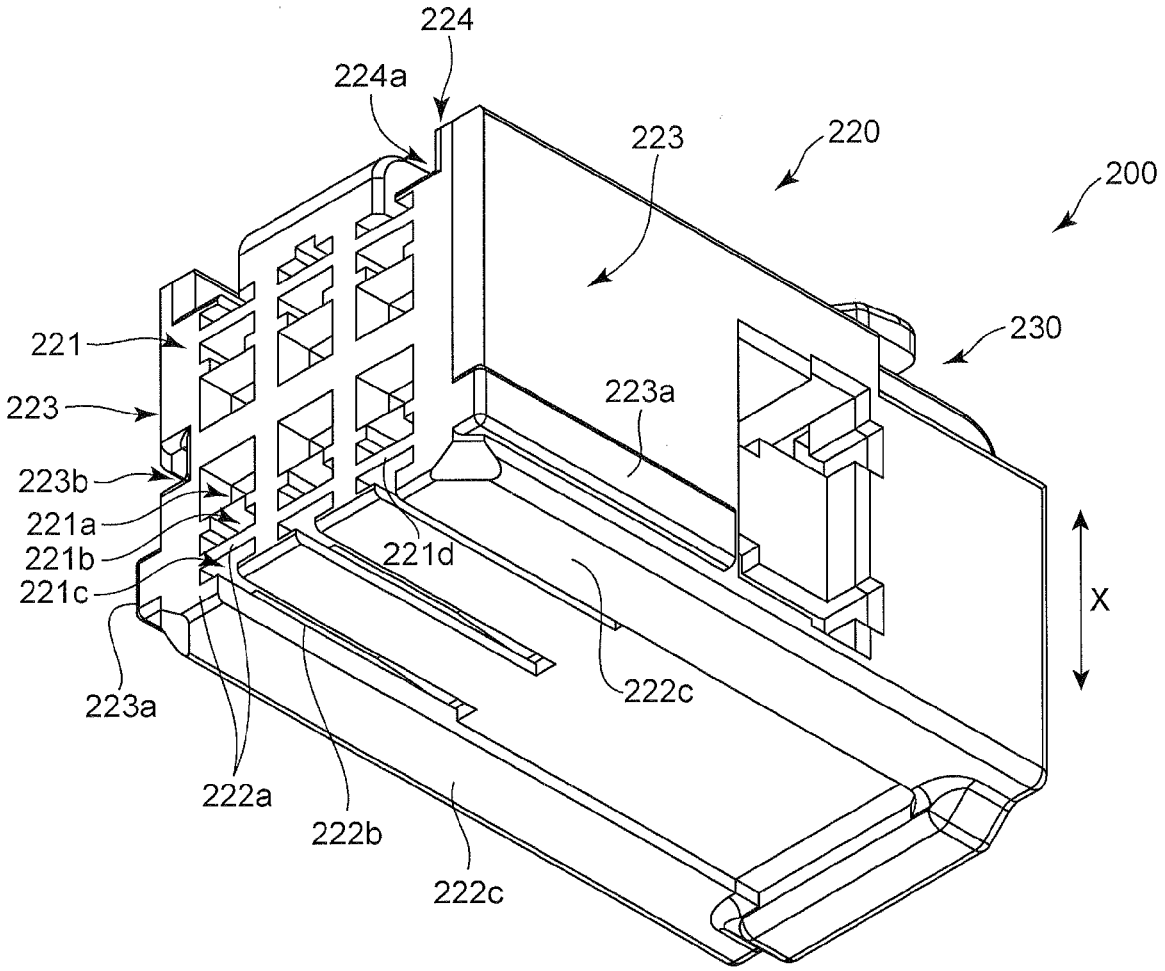
FIG. 5 is a front-downward perspective view of the female electric connector illustrated in FIG. 4.
Figure 6:
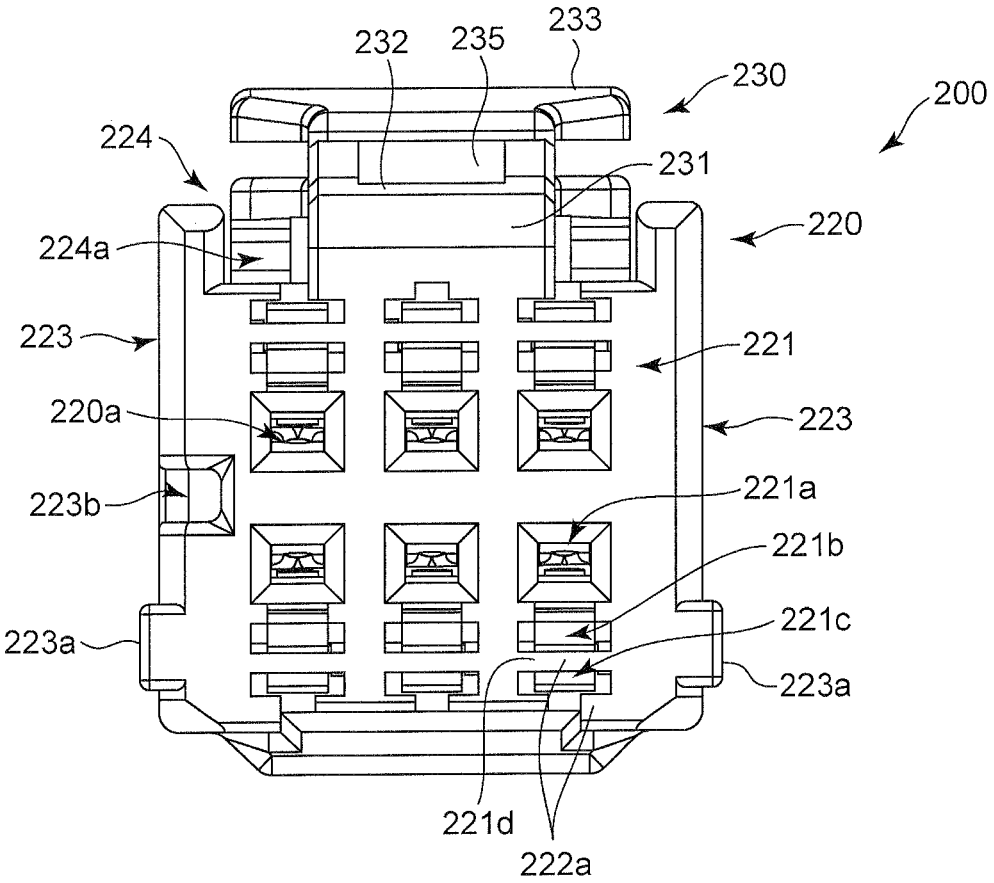
FIG. 6 is a front view of the female electric connector illustrated in FIG. 4.

A male electric connector 100 illustrated in FIGS. 1 to 3 is mounted on a printed circuit board (not illustrated), and is electrically connected to a female electric connector 200 illustrated in FIGS. 4 to 6.

The male electric connector 100 includes a plurality of male connector terminals 110, an outer housing 120, and a fixing unit (not illustrated) through which the outer housing 110 is fixed on a printed circuit board by soldering, for instance.

As illustrated in FIG. 3, the male connector terminals 110 are arranged in an inner space defined in the outer housing 120 horizontally in two rows and vertically in three columns (six male connector terminals 110 in total). The male connector terminals 110 arranged in the upper and lower rows are deviated in centers thereof from each other. Each of the male connector terminals 110 includes a needle-shaped pin 111, a terminal body (not illustrated), and an outer lead 113 to be mechanically and electrically connected to a metal pad mounted on a printed circuit board.

The pin 111 is inserted into and makes electrical contact with a female connector terminal housed in the female electric connector 200. The terminal body is inserted into through-holes formed through the outer housing 120. The outer lead 113 protrudes out of the outer housing 120 through a rear of the outer housing 120. As illustrated in FIG. 2, the outer lead 113 includes at a distal end thereof a connecting portion 113*a* through which the outer lead 113 is connected by means of solder to a meal pad formed as a signal terminal on a printed circuit board.

The outer housing 120 includes a top wall 122, a bottom wall 123, sidewalls 124A and 124B extending in parallel with each other between the top wall 122 and the bottom wall 123, and a rear wall 125. The walls 122, 123, 124A, 124B and 125 define an inner space 121 into which the female electric connector 200 is inserted in parallel with a plane defined by a printed circuit board. The inner space 121 defines an opening 121*a* at a front of the outer housing 120. The outer housing 120 makes contact through the bottom wall 123 with and is mounted on a printed circuit board.

The top wall 122 includes at an inner surface thereof and at a center of the opening 121*a* a guide 122*a* into which a lock arm of the female electric connector 200 is fit. The lock arm of the female electric connector 200 is explained later. As illustrated in FIG. 2, the guide 122*a* includes an inclining surface 122*c* having a smaller thickness at a location closer to the opening 121*a* of the inner space 121, and a recess 122*d* with which the lock arm is engaged.

The top wall 122 includes at an inner surface thereof a pair of first projections 122*b* protruding into the inner space 121. As illustrated in FIGS. 1 and 2, the first projections 122*b* are situated to sandwich the guide 122*a* therebetween. The first projections 122*b* are linearly formed so as to extend from the opening 121*a* towards the rear wall 125 in a direction in which the female electric connector 200 is inserted into the inner space 121.

The first projections 122*b* prevent a different type of a female electric connector other than the female electric connector 200 from being inserted into the inner space 121, prevent the female electric connector 200 from being inserted in an inclining posture into the inner space 121, and prevent the female electric connector 200 from being inserted in an upside-down posture into the inner space 121.

The bottom wall 123 includes, at an inner surface thereof and at opposite ends thereof in a width-wise direction thereof, a pair of linear recesses 123*a* extending in a direction in which the female electric connector 200 is inserted into the inner space 121.

Each of the sidewalls 124A and 124B is formed with a first recess 124*a* in facing relation, as illustrated in FIG. 1. The first recesses 124*a* linearly extend in a direction in which the female electric connector 200 is inserted into the inner space 121. The first recesses 124*a* are formed at an end of the sidewalls 124A and 124B in a height-direction of the outer housing 120. For instance, if the first recesses 124*a* were formed at a center of the sidewalls 124A and 124B in a height-direction of the outer housing 120, the inner housing 220 could be inserted into the inner space 121 of the outer housing 120 even if the inner housing 220 is upside down or inverted. Accordingly, it is necessary for the first recesses 124*a* to be formed at an upper or lower end of the sidewalls 124A and 124B. In the present embodiment, the first recesses 124*a* are formed at a lower end of the sidewalls 124A and 124B of the outer housing 120. In other words, the first recesses 124*a* are formed at an end of the sidewalls 124A and 124B which are opposite to an end closer to the first projections 122*b*.

The first recesses 124*a* are formed at inner surfaces of the sidewalls 124A and 124B. Outer surfaces of the sidewalls 124A and 114B are formed as flat surfaces.

The sidewalls 124B includes at a center of an inner surface thereof a second projection 124*b*, as illustrated in FIGS. 1 and 2. The second projection 124*b* linearly extends in a direction in which the female electric connector 200 is inserted into the inner space 121. The sidewalls 124A and 124B include on outer surface thereof a slot unit 124*c* in which a fixing unit is inserted so that the male electric connector 100 is mounted on a printed circuit board through the fixing unit.

As illustrated in FIGS. 1 and 2, the rear wall 125 includes, on an outer surface thereof and at opposite ends in a width-wise direction of the outer housing 120, standing walls 126 between which the connecting portions 113*a* of the male connector terminals 110 are situated. The standing walls 126 protect the connecting portions 113*a*.

Hereinbelow is explained the female electric connector 200 with reference to the drawings.

The female electric connector 200 illustrated in FIGS. 4 to 7 includes a plurality of female connector terminals 210, an inner housing 220, and a lock arm 230.

Figure 7:
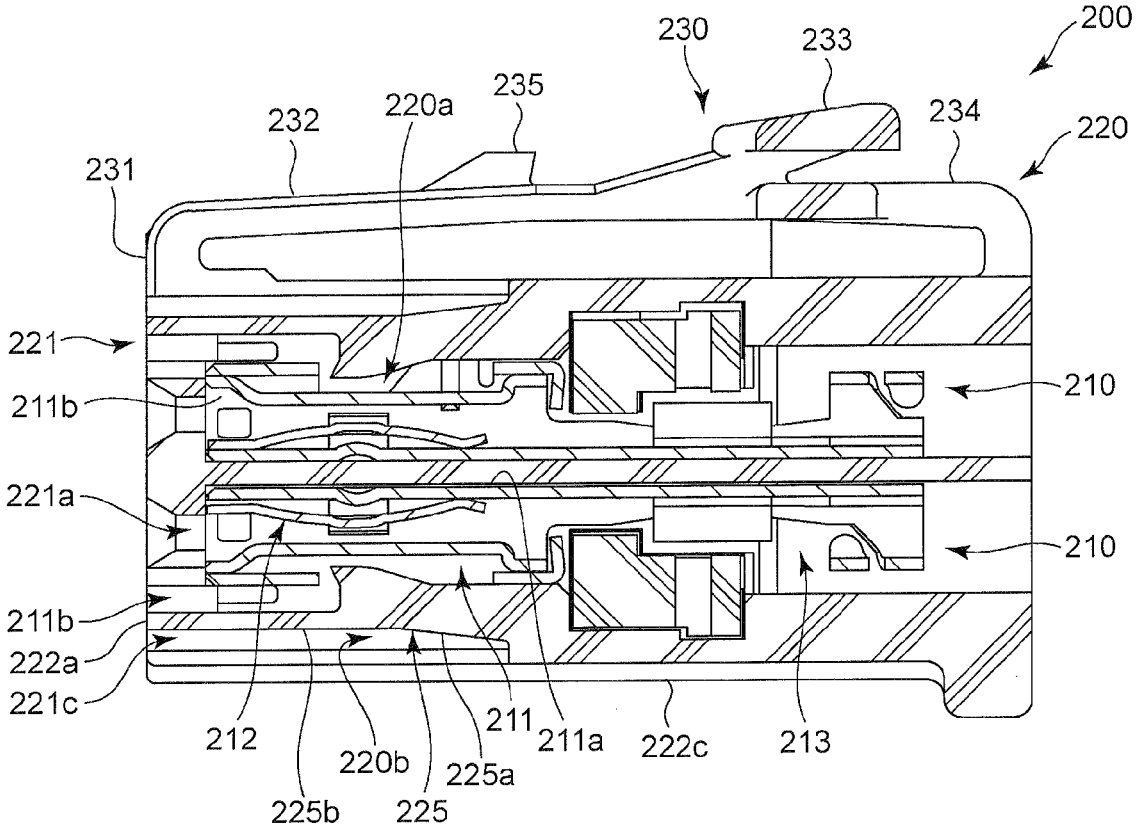
FIG. 7 is a cross-sectional view of the female electric connector illustrated in FIGS. 4 to 6.
Figure 8:
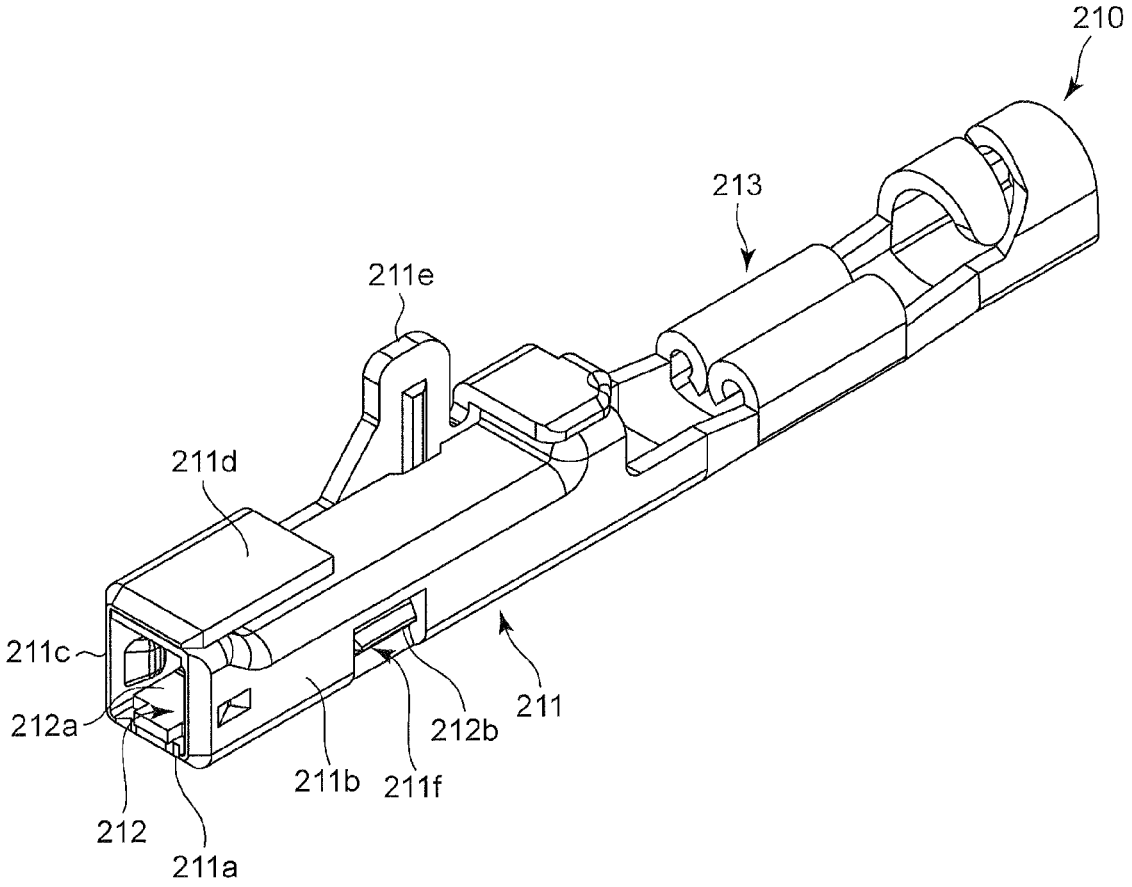
FIG. 8 is a perspective view of a connector terminal to be inserted into the female electric connector illustrated in FIG. 4.
Figure 9:
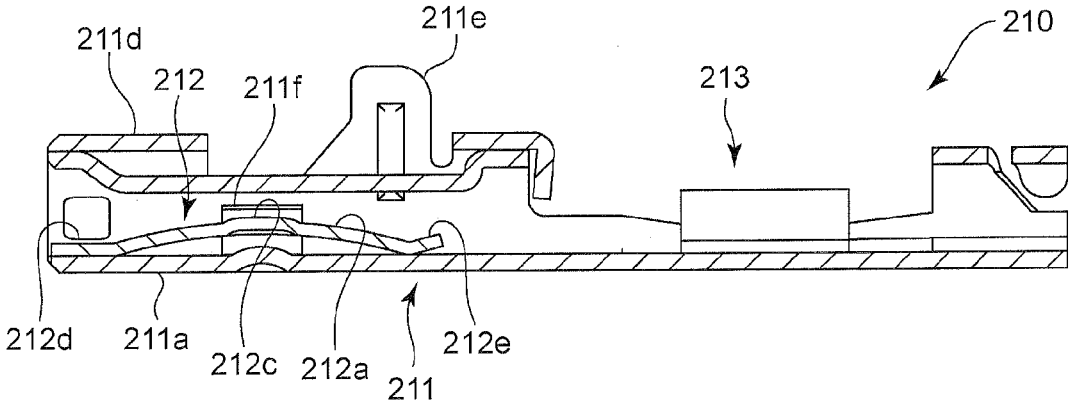
FIG. 9 is a cross-sectional view of the connector terminal illustrated in FIG. 8.

As illustrated in FIGS. 7 to 9, each of the female connector terminals 210 includes an electrically conductive sheath portion 211 to be inserted into the inner housing 220, an elastic contact piece 212 housed in the sheath portion 211 in such a condition that the contact pieces 212 is electrically connected with the sheath portion 211, and a bundle unit 213 continuous to a rear end of the sheath portion 211 for compressing a cable (not illustrated) thereto to thereby fix the cable to the female connector terminal 210.

The sheath portion 211, the elastic contact piece 212 and the bundle unit 213 can be formed integral with one another by bending an electrically conductive metal sheet. As an alternative, the elastic contact piece 212 and the sheath portion 211 may be fabricated as separate parts from each other.

The sheath portion 211 includes a floor 211*a*, a pair of sidewalls 211*b*, and a ceiling 211*d*. The sheath portion 211 can be formed by punching a metal sheet into a desired shape, and bending the punched sheet into a quadratic prism.

One of the sidewalls 211*b* of the sheath portion 211 is formed with a stabilizer 211*e* in order to prevent the inner housing 220 from being inserted into the inner space 121 of the outer housing 120 in an upside-down posture, and further to stabilize the female connector terminal 210 in posture after the female connector terminal 210 is inserted into the inner housing 220.

Each of the sidewalls 211*b* of the sheath portion 211 is formed with a cut-out 211*f* into which an ear portion 212*b* of the elastic contact piece 212 is fit, as illustrated in FIG. 8.

The elastic contact piece 212 is comprised of an arcuate flat spring positioned on the floor 211*a* in a length-wise direction of the sheath portion 211. The elastic contact piece 212 includes an arcuate flat spring 212*a*, a pair of ear portions 212*b* extending from side edges of the flat spring 212*a* at a center of the flat spring 212*a* in a length-wise direction of the flat spring 212*a*, in a direction perpendicular to the length-wise direction of the flat spring 212*a*, and a raised portion 212*c* at a center of the flat spring 212*a* in the length-wise direction of the flat spring 212*a*. The raised portion 212*c* makes contact with the male connector terminal 110.

The elastic contact piece 212 is supported, at a front edge 212*d* and a rear edge 212*e* thereof, on the floor 211*a* of the sheath portion 211. The ear portions 212*b* located at a center in a length-wise direction of the sheath portion 211 are fit into the cut-outs 211*f* formed at the sidewalls 211*b* to thereby prevent the elastic contact piece 211 from displacing towards the ceiling 211*d*. Thus, though the front edge 212*d* and the rear edge 212*e* are free edges, the elastic contact piece 211 can act as an arcuate flat spring.

The raised portion 212*c* is formed to have an arcuate surface by embossing a lower surface of the flat spring 212*a*.

As illustrated in FIGS. 4 to 7, the inner housing 220 has a plurality of terminal spaces 220*a* each of which is in the form of a rectangular parallelepiped and into each of which the female connector terminal 210 is inserted. An arrangement of the terminal spaces 220*a* is identical to that of the male connector terminals 110 housed in the male electric connector 100 (see FIG. 3). Specifically, the terminal spaces 220*a* are arranged horizontally in two rows and vertically in three columns.

The inner housing 220 includes at a front 221 thereof a plurality of first openings 221*a*, a plurality of second openings 221*b*, and a plurality of third openings 221*c*.

The male connector terminals 110 are inserted into the inner housing 220 through the first openings 221*a* to electrically connect with the female connector terminals 210 housed in the terminal spaces 220*a*. A jig for pulling the female connector terminal 210 out of the inner housing 220 is inserted into the inner housing 220 through the second opening 221*b*. The third opening 221*c* leads to a later-mentioned space 220*b* (see FIG. 7).

A bottom wall 222*a* of the inner housing 220 is comprised of a thin wall thinned by the third opening 221*c*. Furthermore, a partition wall 221*d* (see FIG. 5) formed between the second opening 221*b* and the third opening 221*c* is also comprised of a thin wall.

Each of sidewalls 223 of the inner housing 220 includes on an outer surface thereof and at a bottom thereof a third projection 223*a* to be fit into the first recess 124*a*. The third projection 223*a* linearly extends in a direction in which the female electric connector 200 is inserted into the inner space 121. Since the third projections 223*a* are located at a bottom of the sidewalls 223, the third projections 223*a* are on the level with the bottom wall 222*a* comprised of a thin wall. One of the sidewalls 223 of the inner housing 220 includes, on an outer surface thereof and at a center in a height-wise direction thereof, a third recess 223*b* into which the second projection 124*b* is fit. The third recess 223*b* linearly extends in a direction in which the female electric connector 200 is inserted into the inner space 121.

A pair of second recesses 224*a* is formed on an outer surface of a ceiling 224 of the inner housing 220 for allowing the first projections 122*b* of the outer housing 120 to fit into. The lock arm 230 is located between the second recesses 224*a*.

Hereinbelow is explained the bottom wall 222*a* comprised of a thin wall, with reference to FIG. 7.

After having been inserted into the terminal space 220*a*, the female connector terminal 210 is engaged with a lance portion 225. The lance portion 225 includes a hook portion 225*a* having a distal end formed sharpened towards the female connector terminal 210 to be engaged with the female connector terminal 210, and an elastic thin wall portion 225*b* extending between the hook portion 225*a* and the front 221 of the inner housing 200. The female connector terminal 210 is engaged with the hook portion 225*a* to thereby prevent the female connector terminal 210 from being pulled out of the terminal space 220*a*.

In order to pull the female connector terminal 210 out of the inner space 220*a*, a jig (not illustrated) is inserted into the second opening 221*b* to move the lance portion 225 in a direction away from the female connector terminal 210. Thus, the elastic thin wall portion 225*b* is pushed by the jig, and accordingly, the elastic thin wall portion 225*b* and the hook portion 225*a* are deformed towards the space 220*b*, thereby releasing the female connector terminal 210 from the engagement with the hook portion 225*a*.

Then, the female connector terminal 210 is pulled through a rear of the inner housing 220. Thus, the female connector terminal 210 is pulled out of the inner housing 220.

As mentioned above, the space 220*b* is formed to allow the lance portion 225 to move thereinto to thereby release the female connector terminal 210 from the lance portion 225 when the female connector terminal 210 is pulled out of the inner housing 210.

Since the space 220*b* is formed in the inner housing 220, the bottom wall 222*a* is unavoidably thin. Supposing that the inner housing 220 is designed not to include the bottom wall 222*a* and the space 220*b* is therefore exposed outside, there is no wall with which the jig makes abutment, so that the lance portion 225 may make excessive displacement if the jig is moved so much. In contrast, the inner housing 220 in the present embodiment is designed to include the bottom wall 222*a* to partition the space 220*b* from the outside environment, so that the jig is prohibited from moving beyond the bottom wall 222*a*. Thus, the inner housing 220 requires to include the bottom wall 222*a*. For this reason, the inner housing 220 is designed to include the bottom wall 222*a* in order to partition the space 220*b* from the outside environment.

In addition, the partition wall 221*d* partitioning the third opening 221*c* leading to the space 220*b* and the second opening 221*b* through which the jig is inserted into the inner housing 220 is comprised of a thin wall.

As illustrated in FIG. 5, the bottom wall 222*a* includes at an outer surface thereof a recess and slits 222*b* leading to the space 220*b*. The space 220*b* is positioned low in a height-wise direction thereof. Accordingly, a wall by which the space 220*b* is formed in a mold used for fabricating the inner housing 220 with resin is unavoidably thin, and hence, cannot have a sufficient strength. Thus, ribs are formed at the wall in order to reinforce the wall. The ribs defines the slits 222*b* in the inner housing 220. The wall defines the third opening 221*c*.

The bottom wall 222*a* includes at opposite ends in a width-wise direction thereof a pair of linear projections 222*c* to be fit into the linear recesses 123*a* (see FIG. 1) of the outer housing 120.

As illustrated in FIGS. 4 to 7, the lock arm 230 includes a front end 231 connected to the inner housing 220, an arm body 232 supported at an end thereof by the front end 231, a releaser 233 used for releasing the male electric connector 100 from the inner housing 220 of the female connector 200, and a rear end 234 connected to the inner housing 220 and located below the releaser 233.

When the releaser 233 is downwardly pushed to thereby be lowered, the front end 231 is elastically deformed. The arm body 232 is formed with an engagement hook 235 to be engaged with the male electric connector 100 to thereby lock the female electric connector 200 to the outer housing 120. The releaser 233 extends obliquely upwardly towards the rear end 234 from the arm body 232 between the engagement hook 235 and the rear end 234.

When the releaser 233 is downwardly pushed to thereby be lowered, the arm body 232 is elastically deformed with the front end 231 and the rear end 234 both acting as fulcrums, and then, the releaser 233 makes abutment with the rear end 234. Then, the arm body 232 is elastically deformed with the front end 231 and an abutment point both acting as fulcrums. Herein, an abutment point is a point at which the releaser 233 makes abutment with the rear end 234. Thus, the male electric connector 100 is released from the inner housing 220 of the female connector 200.

The outer housing 120 of the male electric connector 100 and the inner housing 220 of the female electric connector 200 are fit into each other as follows.

First, a case in which the female electric connector 200 is fit in a normal posture into the inner space 121 of the male electric connector 100 is explained hereinbelow with reference to FIGS. 10 and 11.

Figure 10:
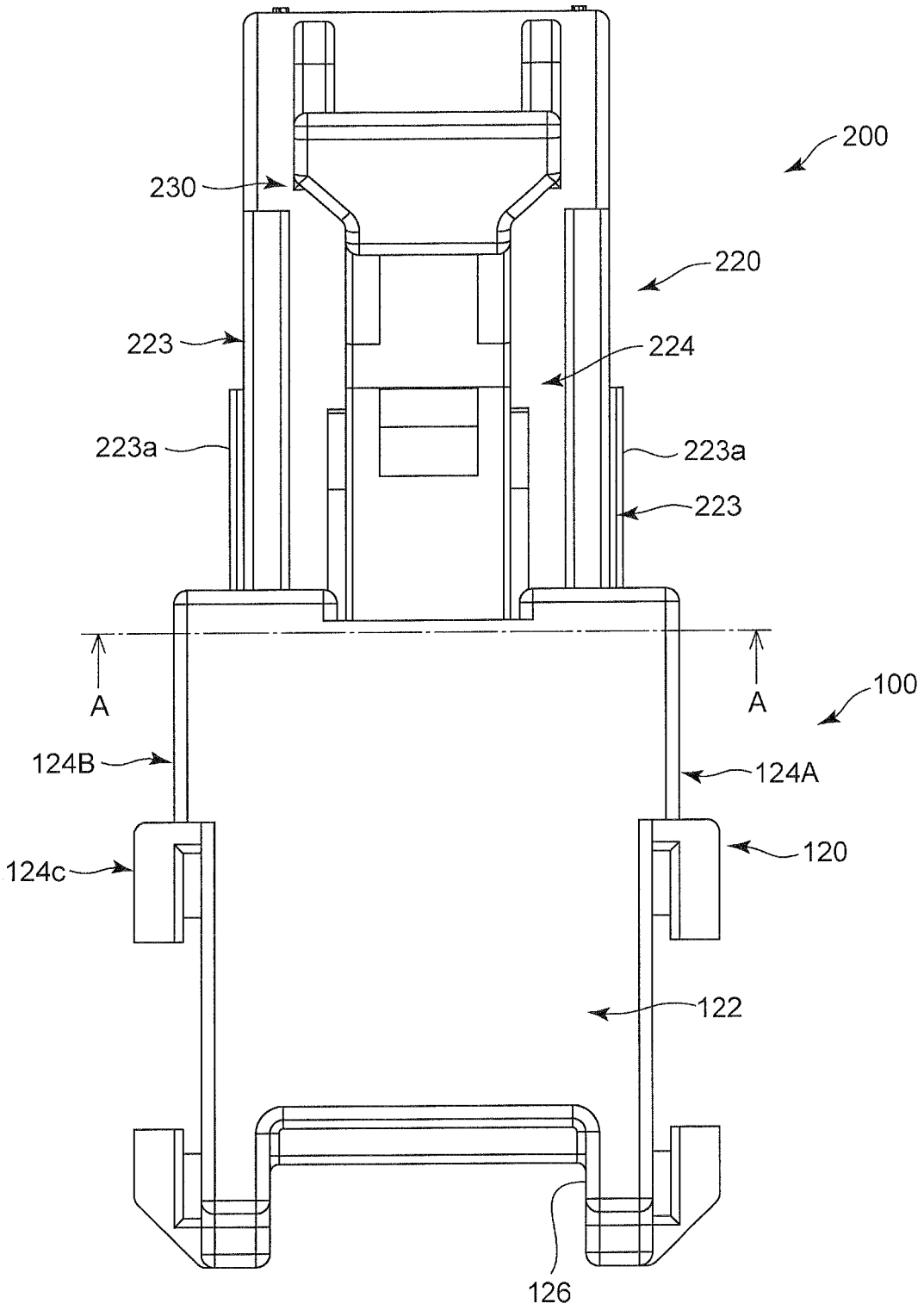
FIG. 10 is a plan view illustrating that an inner housing of the female electric connector illustrated in FIG. 4 is inserted in a normal posture into an outer housing of the male electric connector illustrated in FIG. 1.
Figure 11:
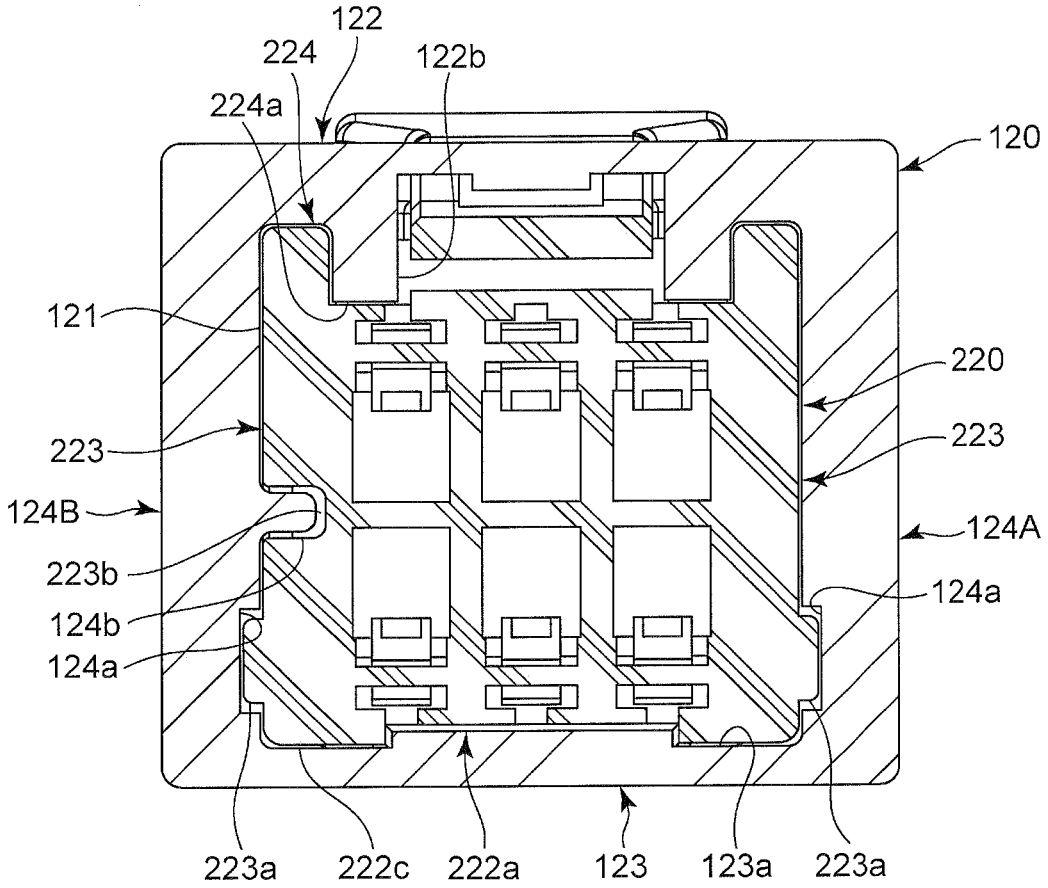
FIG. 11 is a cross-sectional view taken along a line A-A shown in FIG. 10.

As illustrated in FIGS. 10 and 11, when the female electric connector 200 is fit in a normal posture into the inner space 121 of the male electric connector 100, the lock arm 230 is inserted into the guide 122*a* formed at the top wall 122 of the outer housing 120. The first projections 122*b* formed at the top wall 122 of the outer housing 120 are fit into the second recesses 224*a* formed at the ceiling 224 of the inner housing 220.

Furthermore, the third projections 223*a* formed at the sidewalls 223 of the inner housing 220 are fit into the first recesses 124*a* formed at the sidewalls 124A and 124B of the outer housing 120. The second projection 124*b* formed at the sidewall 124B of the outer housing 120 is fit into the third recess 223*b* formed at the sidewall 223 of the inner housing 220.

The linear projections 222*c* formed at the bottom wall 222*a* of the inner housing 220 are fit into the recesses 123*a* formed at the bottom wall 123 of the outer housing 120.

As mentioned above, the projections of the inner housing 220 are fit into the recesses of the outer housing 120, and the projections of the outer housing 120 are fit into the recesses of the inner housing 220 when the female electric connector 200 is fit into the inner space 121 of the male electric connector 100.

Hereinbelow is explained a case in which a user attempts to insert the female electric connector 200 into the inner space 121 of the male electric connector 100 with either one of the male electric connector 100 and the female electric connector 200 being in an upside-down posture, with reference to FIGS. 12 and 13. Specifically, the top wall 122 and the bottom wall 123 of the outer housing 120 are in a posture of being upside down, or the sidewalls 124A and 124B of the outer housing 120 are in a posture of being replaced the right and left to each other. As an alternative, the ceiling 224 and the bottom wall 222*a* of the inner housing 220 are in a posture of being upside down, or the sidewalls 223 of the inner housing 220 are in a posture of being replaced the right and left to each other.

Figure 12:
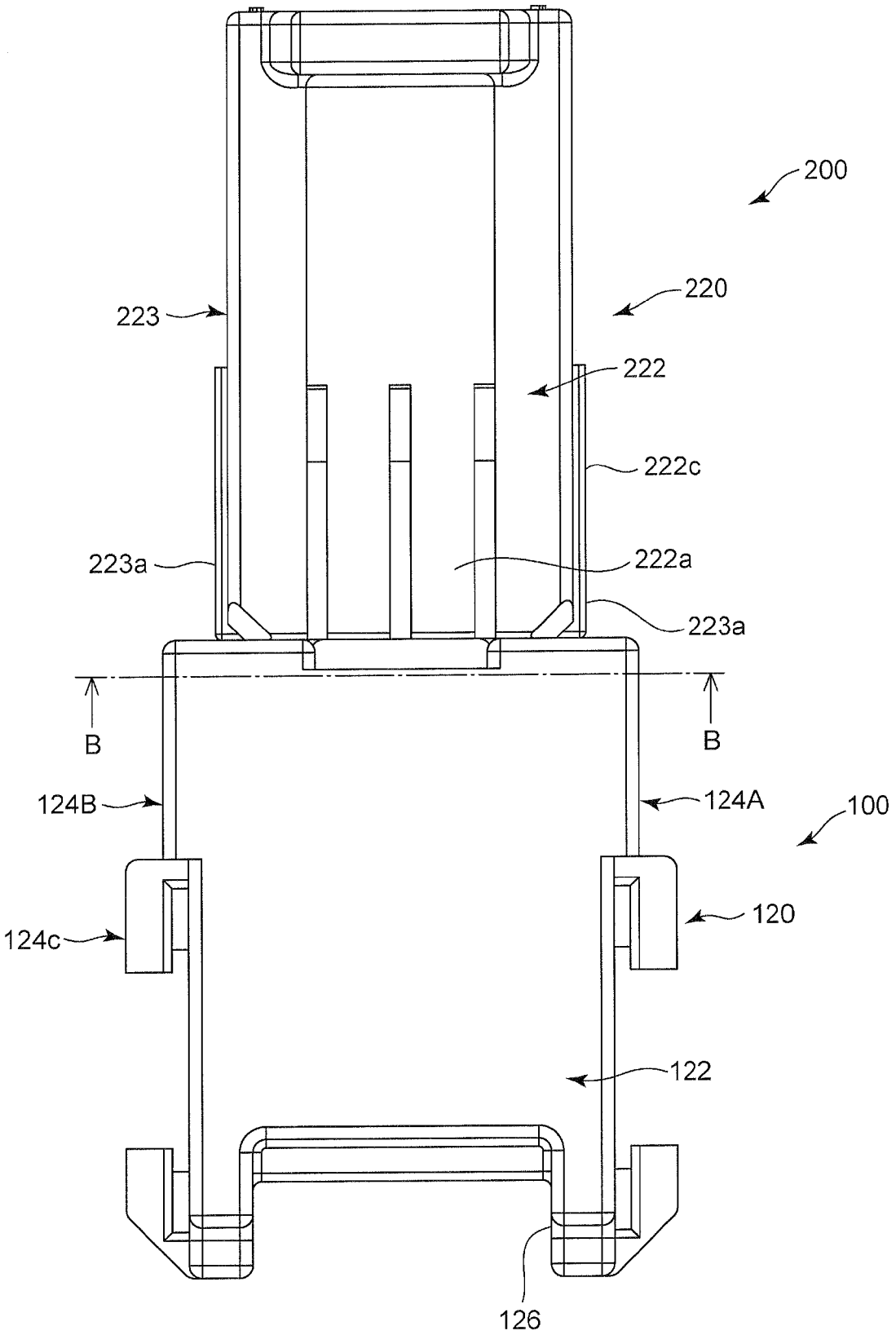
FIG. 12 is a plan view illustrating that the inner housing of the female electric connector illustrated in FIG. 4 is inserted in an upside-down posture into an outer housing of the male electric connector illustrated in FIG. 1.
Figure 13:
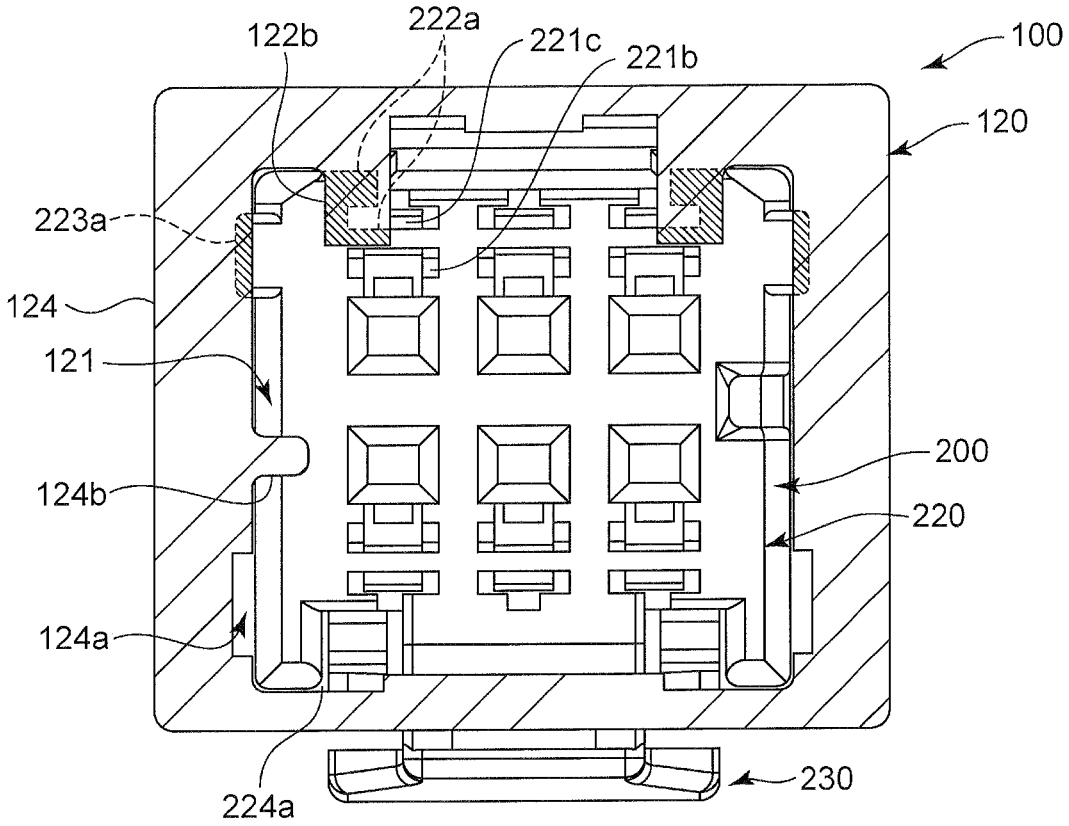
FIG. 13 is a cross-sectional view taken along a line B-B shown in FIG. 12.
Figure 14:
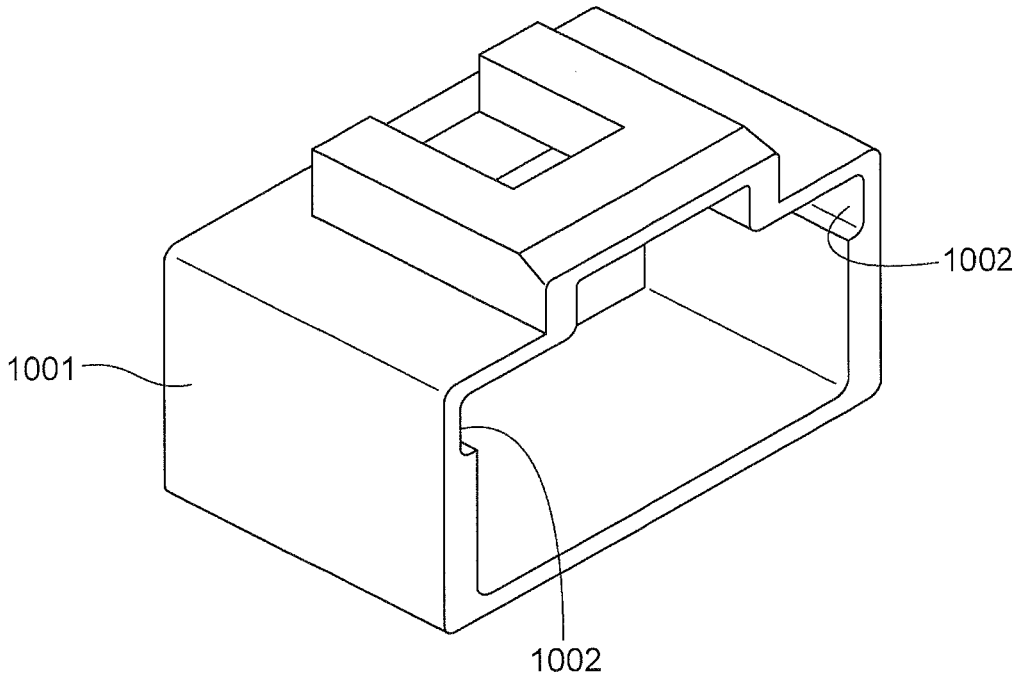
FIG. 14 is perspective view of a female connector of a conventional electric connector.
Figure 15:
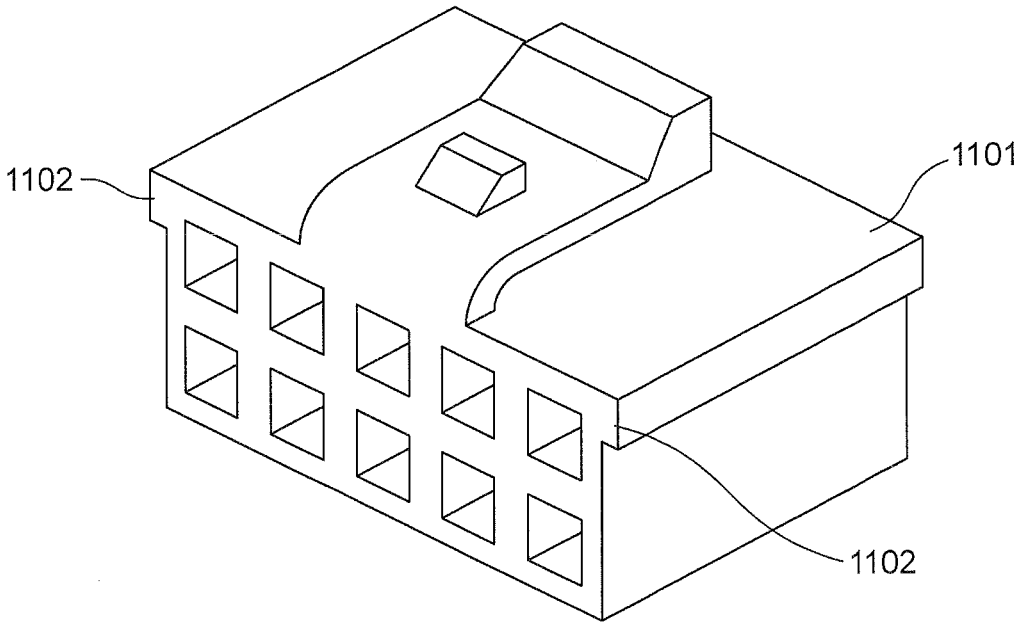
FIG. 15 is a perspective view of a male connector to be fit into the female connector illustrated in FIG. 14.
Figure 16:
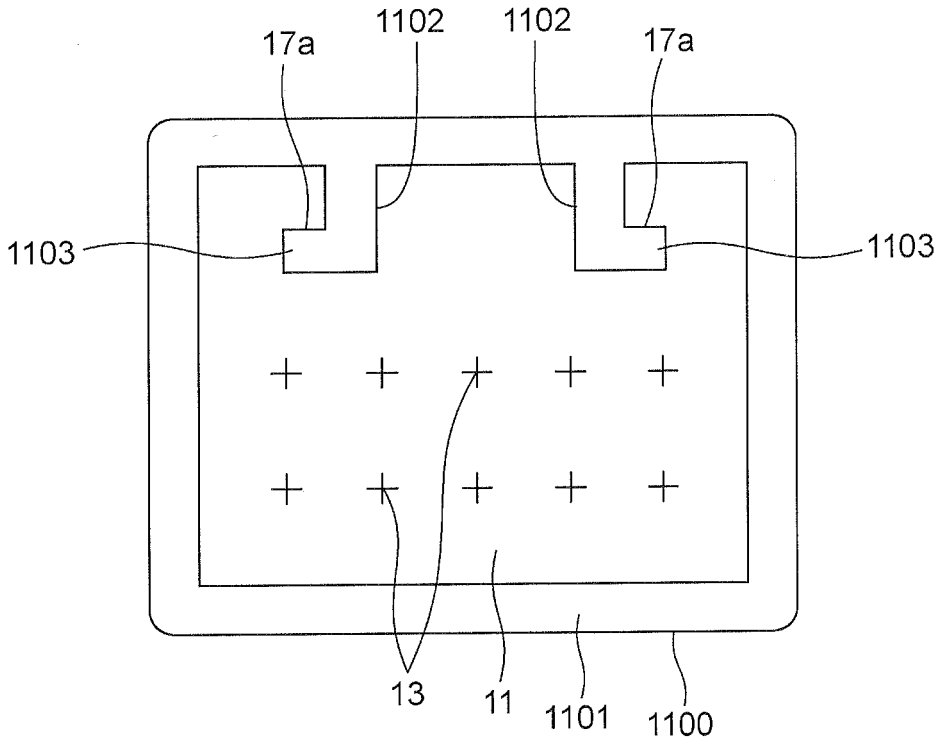
FIG. 16 is a front view of a male housing of a conventional electric connector.
Figure 17:
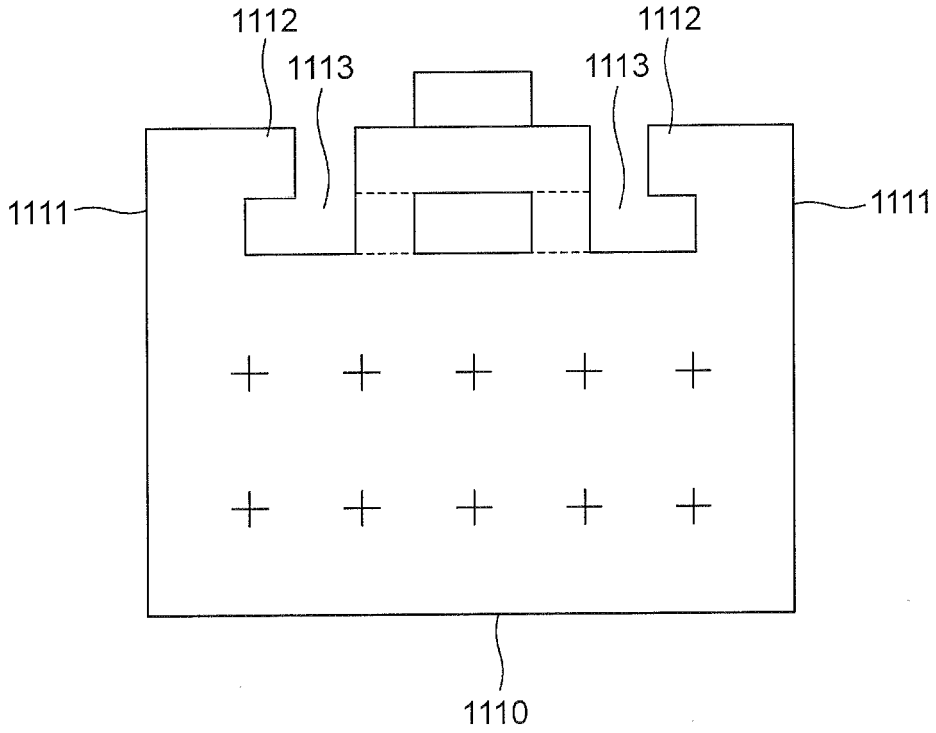
FIG. 17 is a front view of a female housing into which the male housing illustrated in FIG. 16 is fit.
Figure 18:
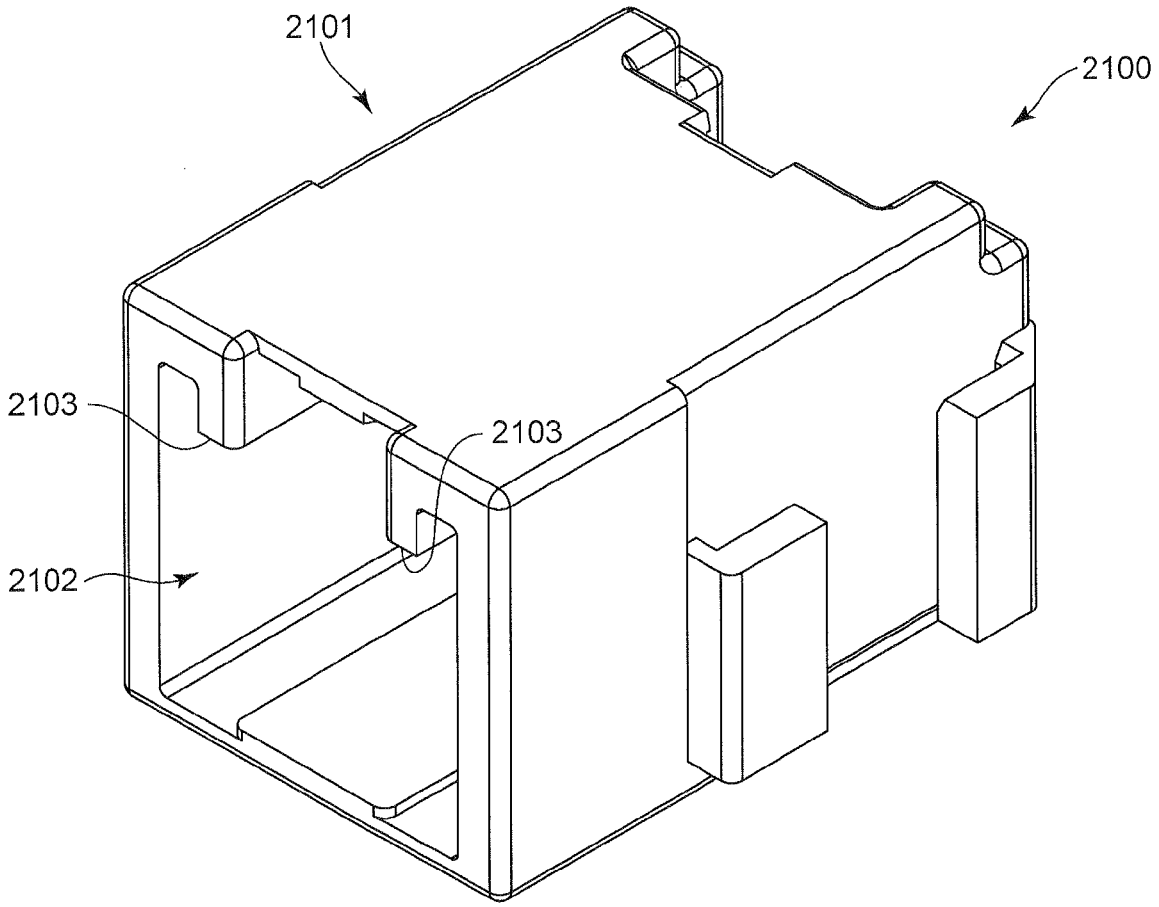
FIG. 18 is a perspective view of an outer housing of a conventional electric connector.
Figure 19:
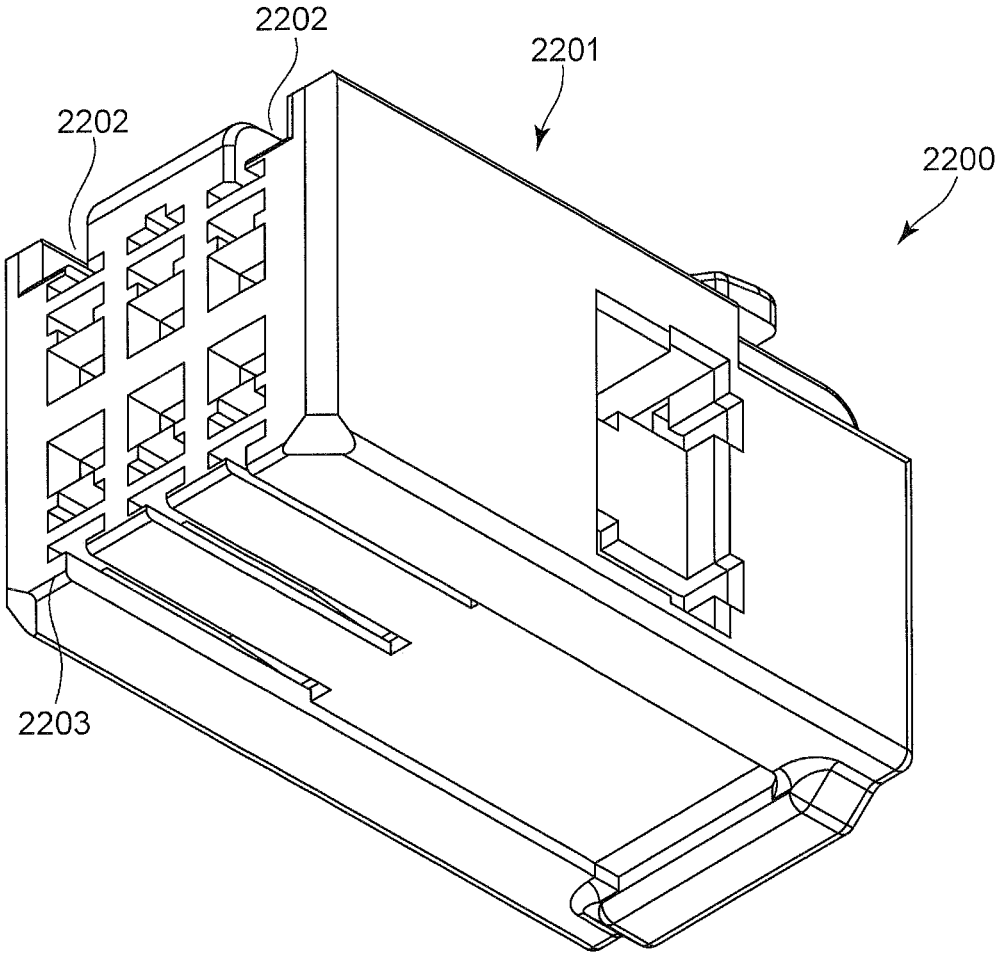
FIG. 19 is a perspective view of an inner housing to be fit into the outer housing illustrated in FIG. 18.

As illustrated in FIGS. 12 and 13, in the case that either one of the male electric connector 100 and the female electric connector 200 is upside down or inverted, the second projection 124*b* formed at the sidewall 124B of the outer housing 120 makes abutment with the front 221 of the inner housing 220.

The front end 231 of the lock arm 230 makes abutment with the bottom wall 123 of the outer housing 120.

Even if the second projection 124*b* of the outer housing 120 makes abutment with the front 221 of the inner housing 220, or the lock arm 230 of the inner housing 220 makes abutment with the bottom wall 123 of the outer housing 120, the front 221 of the inner housing 220 and the bottom wall 123 of the outer housing 120 have a sufficient thickness, and hence, are not damaged. The inner housing 220 cannot be inserted into the inner space 122*a* of the outer housing 120.

The first projections 122*b* formed at the top wall 122 of the outer housing 120 make partial abutment with the bottom wall 222*a* of the inner housing 220. Furthermore, the first projections 122*b* interfere with the partition wall 221*d* partitioning the third opening 221*c* and the second opening 221*b* from each other.

A portion of the bottom wall 222*a* with which the first projections 122*b* make abutment, and the partition wall 221*d* with which the first projections 122*b* make abutment are both comprised of a thin wall. Since the bottom wall 222*a* and the partition wall 221*d* are thinner than the other portions with which the first projections 122*b* make abutment, the bottom wall 222*a* and the partition wall 221*d* may be damaged and/or cracked if the inner housing 220 is forced to be inserted into the inner space 122*a* of the outer housing 120 with the first projection 122*b* making abutment with the bottom wall 222*a* and the partition wall 221*d*.

The sidewalls 223 of the inner housing 220 in the present embodiment are formed with the third projections 223*a* to be fit into the first recesses 124*a* of the outer housing 120. The third projections 223*a* make abutment with the sidewalls 124A and 124B of the outer housing 120, which weakens a compressive force exerted by the first projections 122*b* onto the bottom wall 222*a* and the partition wall 221*d*.

In particular, since the first recesses 124*a* into which the third projections 223*a* are fit are formed at the end of the sidewalls 124A and 124B opposite to the end of the sidewalls 124A and 124B closer to the first projections 122*b*, if the inner housing 220 is upside down, the third projections 223*a* make abutment with the opening 121*a* at the end of the sidewalls 124A and 124B closer to the first projections 122*b*. Accordingly, a compressive force exerted by the first projections 122*b* onto the bottom wall 222*a* and the partition wall 221*d* can be reduced by the third projections 223*a* making abutment with the sidewalls 124A and 124B in the vicinity of the first projections 122*b*.

In addition, since the third projections 223*a* of the inner housing 220 are formed at a position in correspondence to the thin walls 222*a* and 221*d*, even if the inner housing 220 is fit in an upside-down posture into the inner space 121 of the outer housing 120, the third projections 223*a* make abutment with the sidewalls 124A and 124B of the outer housing 120, ensuring that a compressive force exerted by the first projections 122*b* onto the thin walls 222*a* and 221*d* can be reduced by the third projections 223*a* making abutment with the sidewalls 124A and 124B of the outer housing 120.

Consequently, if a user would attempt to insert the inner housing 220 in an upside-down posture into the inner space 121 of the outer housing 120, it would be possible to prevent the thin walls 222*a* and 221*d* from being damaged, even if the bottom wall 222*a* is comprised of a thin wall due to the space 220*b*, or the partition wall 221*d* partitioning the second and third openings 221*b* and 221*c* from each other is comprised of a thin wall. Thus, the electric connector in accordance with the present embodiment provides high reliability to electrical and mechanical connection between the male electric connector 100 and the female electric connector 200.

The first recesses 124*a* are formed at the sidewalls 124A and 124B in facing relation and at the same height as the bottom wall 123, and the third projections 223*a* extend from the sidewalls 223 of the inner housing 220. Thus, even if a projecting length of the third projections 223*a* from the sidewalls 223 is short, a total projecting length of the third projections 223*a* ensures the third projections 223*a* to surely make abutment with the sidewalls 124A and 124B of the outer housing 120. This further ensures that the thin walls 222*a* and 221*d* are protected, and the third projections 223*a* can have an improved strength.

For instance, in the case that the third projections 223*a* are formed at the sidewalls 223 at a center in a height-wise direction of the sidewalls 223, if the inner housing 120 is forced to be inserted into the inner space 121 of the outer housing 120 in an upside-down posture, the third projections 223*a* may outwardly expand or deform the sidewalls 124A and 124B of the outer housing 120 to enter the inner space 121 of the outer housing 110, in which case, the first projections 122*b* compress and thereby damage the thin walls 222*a* and 221*d*.

However, since the third projections 223*a* are formed at an end of the sidewalls 223 in a height-wise direction of the sidewalls 223, the third projections 223*a* make abutment with the sidewalls 124A and 124B of the outer housing 120 in the vicinity of a connection at which the sidewalls 124A and 124B are connected with the top wall 122, and hence, the sidewalls 124A and 124B are difficult to be deformed or outwardly expanded. Thus, it is possible to prevent the inner housing 220 from being fit in an upside-down posture into the inner space 121 into the inner space 121 of the outer housing 120.

The sidewalls 124A and 124B have an outer flat surface. Accordingly, the outer housing 120 is able to have a narrower width than an outer housing in which sidewalls are raised on an outer surface thereof in accordance with the first recesses 124*a*.

In the present embodiment, the bottom wall 222*a* is comprised of a thin wall due to the space 220*b*. The other wall may be comprised of a thin wall.

INDUSTRIAL APPLICABILITY

The electric connector in accordance with the present invention is suitable to an electric connector, as a connector for connecting wires to each other for allowing electric signals to run therethrough, to be broadly used in various fields such as an automobile industry, an electric/electronic device industry and various machine industries.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application Nos. 2014-045428 and 2014-021522 filed on Mar. 7, 2014 and Feb. 6, 2014 including specification, claims, drawings and summary is incorporated herein by reference in its entirety.

What is claimed is:

1. An electric connector including:

a first housing including a first wall, second and third walls both extending in parallel from said first wall, and a fourth wall connecting said second and third walls to each other, said first to fourth walls defining an inner space in said first housing; and a second housing to be fit into said inner space, said first housing including:

a first projection protruding into said inner space from an inner surface of said first wall; and a first recess formed at said second and third walls, said second housing including:

a second recess through which said first projection is guided;

an abutment wall to make abutment with said first projection when said second housing is inserted in an upside-down posture into said inner space; and a second projection to be fit into said first recess, said second projection having a front end aligning with a front end of said second housing, said abutment wall comprising an outer wall thinned by an inner space having a first opening through which a jig is inserted into said space, said outer wall aligning at a front end thereof with said front end of said second housing.

2. The electric connector as set forth in claim 1, wherein said abutment wall comprises a wall formed between a first opening formed at a front of said second housing and a second opening formed at said front of said second housing above said first opening.

3. The electric connector as set forth in claim 2, wherein said second projection has a same height as that of said abutment wall, the height being measured from said fourth wall.

4. The electric connector as set forth in claim 1, wherein said first recess is formed at each of said second and third walls in facing relation.

5. The electric connector as set forth in claim 4, wherein said first recess is formed at a location other than a center of said second and third walls in a height-wise direction of said second and third walls.

6. The electric connector as set forth in claim 5, wherein said first recess is formed at an end of said second and third walls in said height-wise direction.

7. The electric connector as set forth in claim 4, wherein said first recess is formed at an end opposite to an end of said second and third walls located closer to said first projection.

8. The electric connector as set forth in claim 1, wherein said first recess is formed at inner surfaces of said second and third walls, each of said second and third walls having a flat outer surface.

9. The electric connector as set forth in claim 1, wherein said second projection has a same height as that of said abutment wall, the height being measured from said fourth wall.

* * * * *